United States Patent [19]

Suzuki

[11] 4,334,772

[45] Jun. 15, 1982

[54] ELECTROPHOTOGRAPHIC APPARATUS OF RETENTIVE TYPE

[75] Inventor: Yoshiro Suzuki, Hachioji, Japan

[73] Assignee: Olympus Optical Company Limited, Tokyo, Japan

[21] Appl. No.: 116,826

[22] Filed: Jan. 30, 1980

[30] Foreign Application Priority Data

Feb. 2, 1979 [JP] Japan ..... 54/11137

[51] Int. Cl.[3] ..... G03G 15/00; G03G 15/09

[52] U.S. Cl. ..... 355/3 DD; 118/657; 118/658; 355/3 R

[58] Field of Search ..... 355/3 R, 3 DD; 118/653, 118/656, 657, 658, 661

[56] References Cited

U.S. PATENT DOCUMENTS 3,736,055 5/1973 Davidge et al. ..... 355/14
3,923,391 12/1975 Washio et al. ..... 355/3 R
4,081,571 3/1978 Nishihama et al. ..... 355/3 DD X

*Primary Examiner*—Fred L. Braun
*Attorney, Agent, or Firm*—Fleit & Jacobson

[57] ABSTRACT

An electrophotographic apparatus of the retention type for forming a number of copies from the same and single electrostatic charge image once formed on a photosensitive drum by repeating successively developing and transferring operations. The electrophotographic apparatus includes a magnetic brush developing device having a fixed magnet, an aluminum sleeve arranged rotatably around the magnet, and an electrically insulating surface layer applied on the sleeve, on which sleeve surface a two component developing agent consisting of magnetic carriers and insulating toners is adhered as furs of a magnetic brush, whereby a magnetic flux density measured at the sleeve surface in a developing area is set to 600 to 800 Gauss, preferably 650 to 750 Gauss and a distance between the drum and the sleeve is selected to 2 to 5 mm, preferably 3 to 4 mm.

6 Claims, 5 Drawing Figures

ELECTROPHOTOGRAPHIC APPARATUS OF RETENTIVE TYPE

BACKGROUND OF THE INVENTION

The present invention relates generally to an electrophotographic copying apparatus, and more particularly an electrophotographic apparatus of the retention type in which an electrostatic charge image is once formed on a charge retentive member, such as a photoconductive member and an electrically insulating member by means of a well known electrophotography, and a plurality of duplicated copies are formed by repeating successively development and transfer operations without deteriorating or damaging the charge image.

An electrophotographic copying apparatus of such a retention type is known from, for instance U.S. Pat. No. 3,736,055. In addition, FIG. 1 of the present invention is a schematic view showing an embodiment of a copying machine of the retention or multiple-copying type.

In FIG. 1 a reference numeral 1 denotes a photosensitive drum comprising an electrically conductive drum-shaped substrate and a photosensitive layer made of inorganic or organic photosensitive material such as Se, SeTe, CdS, etc. A transparent insulating layer may be applied on the photosensitive layer, if desired. The drum 1 is arranged rotatably in a direction shown by an arrow at a given constant speed. At first, the drum 1 is uniformly charged by a corona charger 2 and then is subjected to an exposure of an image of a document 4 to be copied by means of an optical system 3 to form an electrostatic charge image on the drum 1. The charge image is then developed with a developing agent by a magnetic brush developing device 5 to form a toner image on the drum 1. The toner image is then transported into a transfer section 6 into which a record paper 8 is also fed from a paper cassette 7. The toner image is transferred onto the record paper 8 by a transfer roller 9 made of semi-conductive rubber to which a suitable transfer bias potential is applied. The record paper 8 having the toner image transferred thereto is fed into a fixing device 10 and the toner image is fused onto the record paper 8 to form a final copy. The photosensitive drum 1 is further fed into a cleaning section 11 and residual toner particles on the drum are removed by a cleaning brush 12 and are collected into a suction duct 13. A reference numeral 14 indicates an erasing lamp and a reference numeral 15 a trimming lamp. When it is required to form a plurality of copies from the same and single charge image once formed on the drum 1, the cleaning section 11 is made inoperative by keeping the cleaning brush 12 away from the drum 1 as shown by a dotted line and the drum 1 is subjected repeatedly to the development and transferring operations in succession to form toner images on successively supplied record papers 8.

In order to form a number of copies from the same and single charge image by repeating the developing and transferring operations, it is important that the photosensitive drum 1 has an excellent charge retentive property. That is to say, it is desired that the photosensitive material has a very low dark decay. For instance, the photosensitive layer comprising a Se or SeTe layer and a PVK layer or a thin insulating layer applied on the Se or SeTe layer can be preferably used for the retention type copying machine. Since the photosensitive layer having a high electrostatic capacitance has a very small decay, it is preferable that the thickness of the photosensitive layer is made small. To this end, the thickness of Se or SeTe layer is preferably selected to about 10 to 30$\mu$.

As explained above, the potential of charge image on the photosensitive layer might be decreased due to the dark decay. Further, it has been found that the charge image might be deteriorated in the magnetic brush developing step due to the fact that conductive or semiconductive carriers contained in the developing agent are made directly in contact with the charge and a leakage current might flow through the carriers.

In order to avoid the above mentioned decay of the charge during the development, it is known to use specially treated carriers. For instance, in Japanese Patent Publication No. 17,198/74, there is disclosed a technique for increasing a resistance of the developer agent by coating the carrier particles with insulating surface layers.

However, when such insulating carriers are used, the developing electrode effect inherent to the magnetic brush development might be decreased and a so-called edge effect might occur to deteriorate a copy image quality. In order to compensate for such an edge effect, it is necessary to take a step such as a prolongation of the developing time, i.e., a decrease in the copying speed, an increase of the number of developments by arranging serially a plurality of magnetic brush developing devices. However, such a measure results in an increase in the cost of the copying apparatus as well as a decrease in copying speed.

SUMMARY OF THE INVENTION

The present invention has for its object to provide an electrophotographic apparatus of the retention type which can form at a high speed a number of duplicated copies of high quality by repeating developing and transferring operations for the same and single electrostatic charge image without deteriorating the charge image during the development although use is made of conductive or semiconductive carriers.

The present invention is based on such a recognition that the deterioration of the charge image and the decrease in the image quality can be substantially obviated by suitably selecting the developing condition in the magnetic brush development.

According to the invention an electrophotographic apparatus of the retention type for printing a plurality of duplicated copies from the same and single electrostatic charge image once formed on an electrostatic charge retentive member by repeating developing and transferring operations in succession, comprises a magnetic brush developing device including a magnet device and an electrically insulating surface on which a two component developing agent consisting of magnetic carriers and insulating toners is retained, a magnetic flux density measured at the developing agent retentive surface being set in a range of about 600 to 800 Gauss and a distance between the charge retentive member and the developing agent retentive surface being set to about 2 to 5 mm.

In a preferred embodiment of the electrophotographic apparatus according to the invention, the magnetic brush developing device comprises a doctor blade for defining a length of furs of the magnetic brush to be shorter than about 6 mm, so that a contact length of that part of the furs which is made in contact with the charge retentive member is set to about 0.3 to 2.0 mm.

In another preferable embodiment of the electrophotographic apparatus according to the invention a toner concentration of the two component developing agent is set to be higher than about 6% by weight.

DESCRIPTION OF THE PREFERRED EMBODIMENTS

Figure 1:
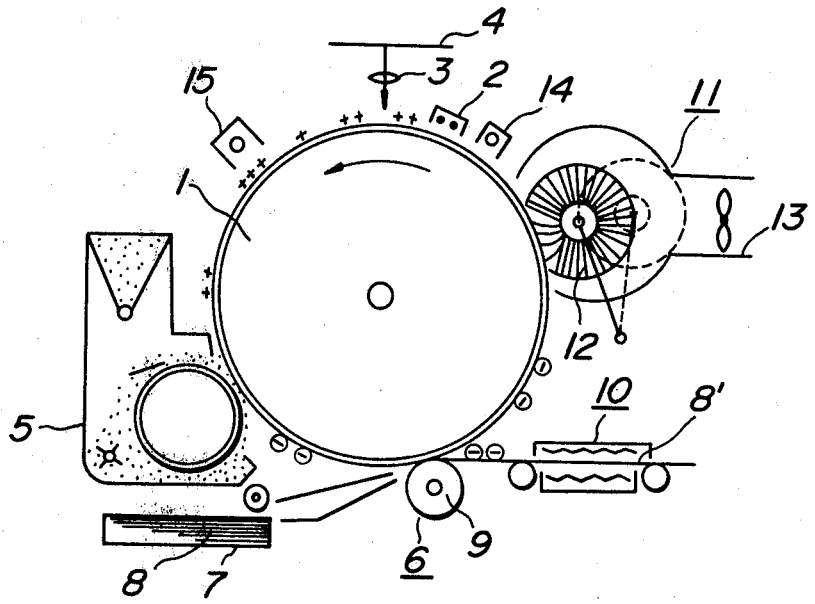
FIG. 1 is a schematic view showing an embodiment of an electrophotographic copying machine of the retention type to which the present invention may be applied.
Figure 2:
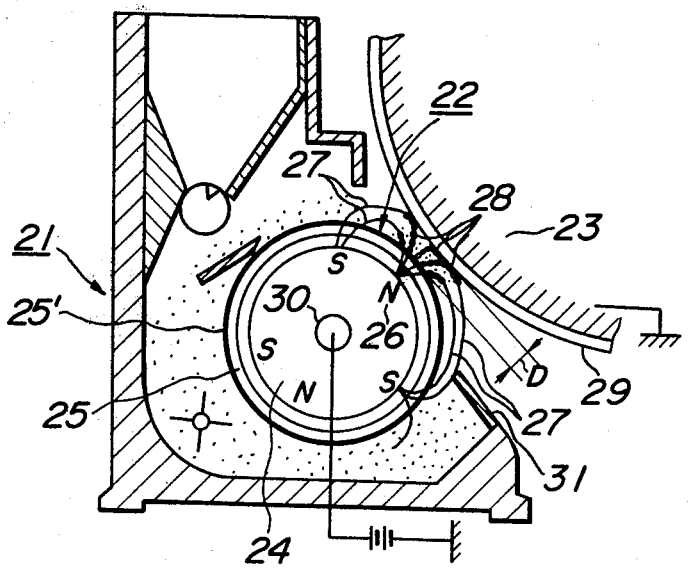
FIG. 2 is a sectional view illustrating an embodiment of a magnetic brush developing device of the electrophotographic apparatus according to the invention.

FIG. 2 is a schematic view illustrating a magnetic brush developing device for use in an electrophotographic apparatus according to the invention. The developing device 21 comprises a developing roller 22 rotatably arranged in opposite to a photosensitive drum or electrostatic charge retentive member 23. The developing roller 22 comprises a fixed magnet roller 24 having magnetic poles embedded at given positions and a non-magnetic sleeve 25 arranged rotatably around the magnet roller 24. The developing roller 22 may be formed by a rotating magnet roller having poles embedded in non-magnetic insulating material. In case of the fixed magnet roller, one of its poles 26 is opposed to the photosensitive drum 23 at a developing area. The sleeve 25 constitutes a surface for holding or retaining a developing agent consisting of insulating toners and conductive or semiconductive magnetic carriers. Due to an action of lines 27 of magnetic force of the magnetic roller 24, the developing agent is arranged as a brush 28 as shown in FIG. 2. The magnetic brush 28 thus formed is rotated in accordance with the rotation of the sleeve 25 and is made in contact with the surface 29 of the electrostatic charge retentive member 23 to develop the latent image with toners.

Figure 3:
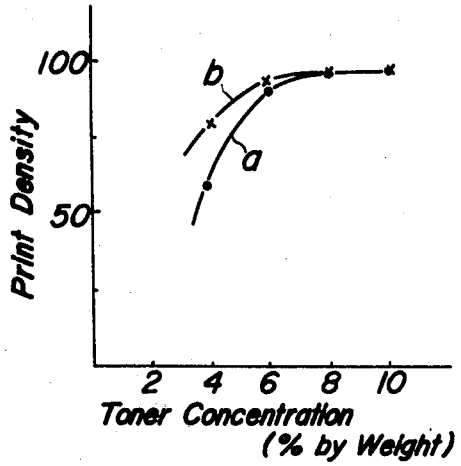
FIG. 3 is a graph showing a relationship between print density and toner concentration.

According to the invention, conductive or semiconductive iron carriers may be used as the carrier particles. FIG. 3 is a graph showing a decay of the charge potential by plotting on an ordinate a print density, i.e., a relative density ratio (%) of a twentieth copy with respect to a print density (100%) of a first copy and a toner containing ratio (% by weight) of the developing agent on an abscissa. In FIG. 3, curve a represents a case in which conductive carriers are used and curve b, a case in which use is made of semiconductive carriers having an iron oxide surface layer of a specific resistance of $10^5$ to $10^8$ Ω-cm.

From the graph of FIG. 3, it can be understood that the deterioration in the charge potential can be made small, if use is made of the developing agent having a toner concentration higher than about 6% by weight. Therefore, according to the invention, the toner concentration is determined to be higher than about 6% by weight. When the developing agent having an excessively higher toner concentration is used, the toners which are not stuck to the carriers might spread and thus the toner concentration should be lower than ten and several percentages by weight. On the contrary, in the known apparatuses in which a single copy is formed from a respective charge image, use is generally made of the developing agents having the toner concentration from 3 to 5% by weight. In this case, as shown in FIG. 3, the image quality of the twentieth copy formed from the same and single charge image might be deteriorated to a great extent. In order to avoid the decrease in the charge potential, it is preferable that the magnetic brush 28 is made in contact with the charge as little as possible and then the development efficiency might be decreased. However, according to the invention, the decrease in the development efficiency can be compensated for by using the developing agent having the higher toner concentration.

In general, a great amount of light is necessary for decreasing the charge potential at an imagewise bright area to a zero volt and thus a residual potential of about 50 to 100 volts generally remains on the photosensitive layer. Due to this residual potential, the imagewise bright portions might be overdeveloped and a so-called fog is formed. In order to avoid such a fog, a developing bias voltage is applied through a rotating shaft 30 to the electrically conductive sleeve 25 as schematically shown in FIG. 2. In this case, it has been found that the charge on the photosensitive drum 23 is decayed through the conductive or semiconductive carriers and conductive sleeve 25. According to the invention in order to avoid such a drawback, an insulating layer 25' is applied on the sleeve surface so as to obviate the deterioration of the charge even if the developing agent is made in contact with the electrostatic charge on the photosensitive drum 23. In case of using the rotating magnet roller, an insulating coating may be provided on its surface. The insulating layer on the sleeve may be formed by an aluminum oxide layer of 5 to 50μ thickness grown on the aluminum sleeve or by an insulating organic resin having a specific resistance higher than $10^{10}$ Ω-cm.

When the sleeve having the insulating coating applied thereon is used, the function of developing electrode might be decreased and the edge effect might appear. According to the invention, such a drawback can be removed by decreasing a distance D between the sleeve 25 and the drum surface 29. In the known electrophotographic apparatus for forming a single copy from a single charge image, said distance D is generally set to about 6 to 8 mm.

The inventor has found after various experiments that the deterioration in charge image potential is related to a height of furs of magnetic brush 28 and an amount of the developing agent which is made in contact with the drum surface 29 as well as the magnetic flux density of the developing magnetic pole of the magnet roller. The inventor has further found that by selecting suitably the developing condition it is possible to print a number of copies of good image quality from the same and single electrostatic charge image.

Figure 4:
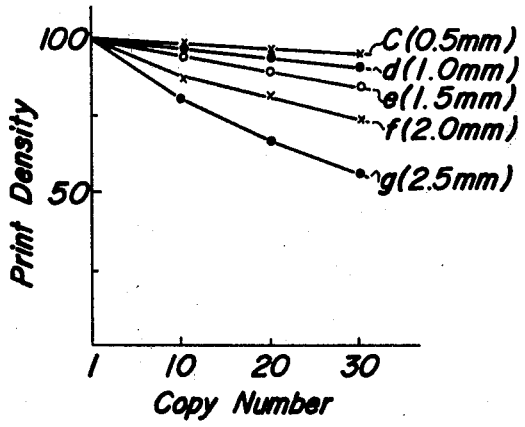
FIG. 4 is a graph depicting a relationship between print density and contact length of magnetic brush.

FIG. 4 is a graph showing a relationship between the print density and a length of that part of the magnetic brush which is made in contact with the drum surface. This contact length can be measured as a difference between a whole length l of a fur of the magnetic brush at the pole 26 and the distance D between the sleeve 25 and drum 23. Curves c, d, e, f and g show print density characteristics at various contact lengths (l-D) of 0.5 mm, 1.0 mm, 1.5 mm, 2.0 mm and 2.5 mm, respectively.

As clearly shown in FIG. 4, when the contact length is longer than about 2.0 mm, the print density of 20th to 30th copies are decreased to a great extent. Therefore, according to the invention, the contact length is selected to be smaller than about 2.0 mm. On the contrary, if the contact length is set to be excessively small, an amount of toners serving for the development might be decreased and thus good development could not be achieved. Therefore, according to the invention, the contact length is made longer than about 0.3 mm. The length l of the magnetic brush can be adjusted by a doctor blade 31 shown in FIG. 2. As explained above, the distance D between the sleeve 25 and the drum surface 29 is intimately related to the quality of printed copy. In order to decrease the edge effect, the distance D is set shorter than about 5 mm, preferably 3 mm to 4 mm. Therefore, the height l of magnetic brush is adjusted by the doctor blade 31 to a value smaller than about 6 mm, preferably smaller than about 5 mm. In a practical apparatus the blade distance is set to about 2 mm to 3 mm.

Figure 5:
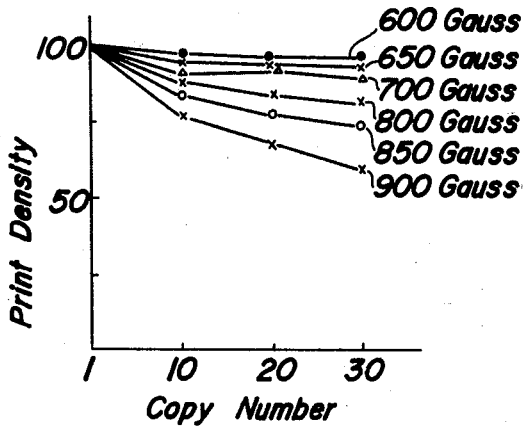
FIG. 5 is a graph illustrating a relationship between print density and magnetic flux density of a magnetic brush developing device.

FIG. 5 is a graph showing a relationship between the print density and the magnetic flux density measured on the sleeve surface at the developing pole 26 of the developing magnet roller 24. As illustrated in FIG. 5, the deterioration of the print density does hardly occur at the magnetic flux density lower than about 800 Gauss. This is due to the fact that the developing agent retentive surface, i.e., the sleeve surface is made closer to the photosensitive drum in order to compensate the edge effect and the length of the brush is made smaller by making the contact length of magnetic brush on the drum surface smaller, if the magnetic flux density is made high, the furs of the magnetic brush become hard or rigid as like as needles and thus the leakage current might be increased.

Further, if the furs of magnetic brush are hard, the image quality might be reduced due to the fact that the magnetic brush furs might scrape the toners off the imagewise black area. On the contrary, if the magnetic flux density is decreased smaller than about 600 Gauss, the magnetic attractive force is too decreased to hold the carriers and toners efficiently and they might spread to a great extent.

In the known electrophotographic apparatus for forming a single copy from a respective charge image in order to enhance the developing function the magnetic brush furs can be made sufficiently long and thus a great amount of the toners can be made in contact with the charge image. For this purpose, the magnetic flux density is set to a higher value such as 800 to 900 Gauss. According to the invention, the magnetic flux density at the sleeve surface is set to about 600 to 800 Gauss, preferably to about 650 to 750 Gauss.

As described above, according to the electrophotographic apparatus of the invention, a number of copies such as thirty copies of good image quality can be formed at a high speed from the same and single electrostatic charge image even if the developing agent containing conductive or semiconductive carrier particles is used.

The present invention is not limited to the embodiments explained above, but many modifications can be conceived within the scope of the invention. For instance, in the above embodiment, the charge retentive member is formed as the photosensitive drum, but it may be shaped as a sheet or belt. Further, the charge retentive member need not be made of photosensitive material, but may be made of dielectric material having no photosensitive property. In such a case, the electrostatic charge image may be formed on the charge retentive member by means of known TESI method, ion stream modulation method with a photosensitive screen, etc.

What is claimed is:

1. In an electrophotographic apparatus for printing a plurality of duplicated copies from the same and single electrostatic charge image once formed on the surface of an electrostatic charge retentive member by repeating developing and transferring operations in succession, a magnetic brush development device comprising: an electrically conductive sleeve; an electrically insulating layer applied on said sleeve, said insulating layer having a magnetic flux density in the range of about 600 to 800 Gauss, a surface resistance higher than about $10^{10}\Omega$-cm, and being positioned a distance in the range of about 2 to 5 mm from the surface of the charge retentive member; a magnet device arranged inside said sleeve to form on a surface of said insulating layer a magnetic brush of a two component developing agent consisting of magnetic carriers having a surface resistance lower than about $10^{8}\Omega$-cm and insulating toners, said toners representing greater than 6% of the total weight of said agent; a doctor blade for defining furs of said magnetic brush, said furs for developing said charge image with said toners to form a toner image on the surface of said charge retentive member, each of said furs having a length less than approximately 6 mm, the difference between said fur length and the distance between said sleeve and said surface of the charge retentive member being less than about 2.0 mm; and a device for transferring said toner image onto a record paper to form a copy.

2. An apparatus according to claim 1, wherein said two component developing agent includes electrically semiconductive carriers having a surface resistance of about $10^5$ to $10^8$ $\Omega$-cm.

3. An apparatus according to claim 1, wherein said magnetic flux density is selected to about 650 to 750 Gauss.

4. An apparatus according to claim 1, wherein said distance between the charge retentive member and the insulating layer is selected to about 3 to 4 mm.

5. An apparatus according to claim 1, wherein said length of magnetic brush furs is selected to be lower than about 5 mm and the length of that portion of the magnetic brush furs which is made in contact with the charge retentive member is set to be shorter than about 1.0 mm.

6. An apparatus according to claim 1, wherein the magnetic brush developing device further comprises a fixedly arranged magnet and wherein said sleeve is made of aluminum has an electrically insulating surface layer of aluminum oxide, and is rotatable relative to said magnet.

* * * * *